US010865087B2

(12) United States Patent
Graffin

(10) Patent No.: US 10,865,087 B2
(45) Date of Patent: Dec. 15, 2020

(54) FILLER SPOUT WITH LEAK LIMITATION

(71) Applicant: Serac group, La Ferte Bernard (FR)

(72) Inventor: André Jean-Jacques Graffin, Chicago, IL (US)

(73) Assignee: Serac Group, La Ferte Bernard (FR)

( * ) Notice: Subject to any disclaimer, the term of this patent is extended or adjusted under 35 U.S.C. 154(b) by 39 days.

(21) Appl. No.: 15/641,943

(22) Filed: Jul. 5, 2017

(65) Prior Publication Data

US 2018/0009645 A1 Jan. 11, 2018

(30) Foreign Application Priority Data

Jul. 5, 2016 (FR) ..... 16 56441

(51) Int. Cl.
*B67C 3/28* (2006.01)
*B67C 3/26* (2006.01)
*B67C 3/20* (2006.01)

(52) U.S. Cl.
CPC ..... *B67C 3/2608* (2013.01); *B67C 3/202* (2013.01); *B67C 3/28* (2013.01)

(58) Field of Classification Search
CPC B67C 3/28; B67C 3/281; B67C 3/286; B67C 3/2608
USPC ..... 141/39, 57, 146, 255, 258, 264, 301
See application file for complete search history.

(56) References Cited

U.S. PATENT DOCUMENTS

| | | | | |
|---|---|---|---|---|
| 5,878,992 | A | 3/1999 | Edwards et al. | |
| 2003/0196721 | A1 * | 10/2003 | Graffin | B67C 3/26 141/302 |
| 2005/0217752 | A1 * | 10/2005 | Facchini | A61J 3/074 141/146 |
| 2006/0266003 | A1 * | 11/2006 | Topf | B67C 3/007 53/281 |
| 2017/0283233 | A1 * | 10/2017 | Clusserath | B67C 3/281 |

FOREIGN PATENT DOCUMENTS

| | | | | |
|---|---|---|---|---|
| DE | 102014113488 | A1 | 3/2016 | |
| EP | 0894723 | A1 | 2/1999 | |
| EP | 3031774 | A1 | 6/2016 | |
| FR | 2983843 | A1 | 6/2013 | |
| WO | WO0140098 | A1 | 6/2001 | |
| WO | WO-2016042102 | A1 * | 3/2016 | B67C 3/2608 |

* cited by examiner

*Primary Examiner* — Paul J Gray
(74) *Attorney, Agent, or Firm* — Muncy, Geissler, Olds & Lowe, P.C.

(57) ABSTRACT

A filler spout including a tubular body having mounted therein a valve member extending facing a valve seat and a secondary shutter arranged in a distribution chamber downstream from the valve member and rigidly connected thereto with a small amount of axial clearance between the valve member and the secondary shutter, and a movable portion of an actuator being coupled to the valve member in order to move it between an extreme closure position and an extreme opening position. The valve member possesses an intermediate closure position and includes a portion that is received in a bore opening out into the distribution chamber in order to form a suction system when the valve member is moved from the extreme closure position to the intermediate closure position.

10 Claims, 5 Drawing Sheets

FILLER SPOUT WITH LEAK LIMITATION

The present invention relates to filling containers with liquid fluids that are more or less viscous, and that are possibly foamy.

BACKGROUND OF THE INVENTION

Containers are filled under industrial conditions in filler installations having filler spouts and means for bringing containers under the filler spouts.

Filler spouts are known that comprise a tubular body in which there are mounted a valve member extending facing a valve seat, and a secondary shutter arranged in a distribution chamber downstream from the valve member and connected thereto. In the closed position, an O-ring mounted on the valve member bears against the seat and the secondary shutter is in contact with or in the vicinity of a wall of the body defining an outlet opening for the fluid at a bottom end of the spout.

With that type of filler spout, and also with others, there exists a risk of a drop forming at the bottom end of the spout, which drop runs the risk of falling and dirtying the outsides of containers and/or of portions of the installation located below the spout.

BRIEF SUMMARY OF THE INVENTION

An object of the invention is to propose a filler installation that is cleaner.

To this end, the invention provides a filler spout comprising a tubular body having mounted therein a valve member extending facing a valve seat and a secondary shutter arranged in a distribution chamber downstream from the valve member and rigidly connected thereto, leaving a small amount of axial clearance between them, and a movable portion of an actuator being coupled to the valve member in order to move it between an extreme closure position and an extreme opening position. The valve member possesses an intermediate closure position and comprises a portion that is received in a bore opening out into the distribution chamber in order to form a suction system when the valve member is moved from the extreme closure position to the intermediate closure position.

Thus, when the valve member passes from its extreme closure position to its intermediate closure position, the valve member creates suction in the distribution chamber and sucks up the fluid towards the top of the distribution chamber. This arrangement enables the spout to be closed cleanly and limits the risk of liquid leaking to the outside of the spout.

BRIEF DESCRIPTION OF THE DRAWINGS

Other characteristics and advantages of the invention appear further on reading the following description of a particular embodiment of the invention and several variants thereof, given with reference to the accompanying figures, in which.

DETAILED DESCRIPTION OF THE INVENTION

Figure 1:
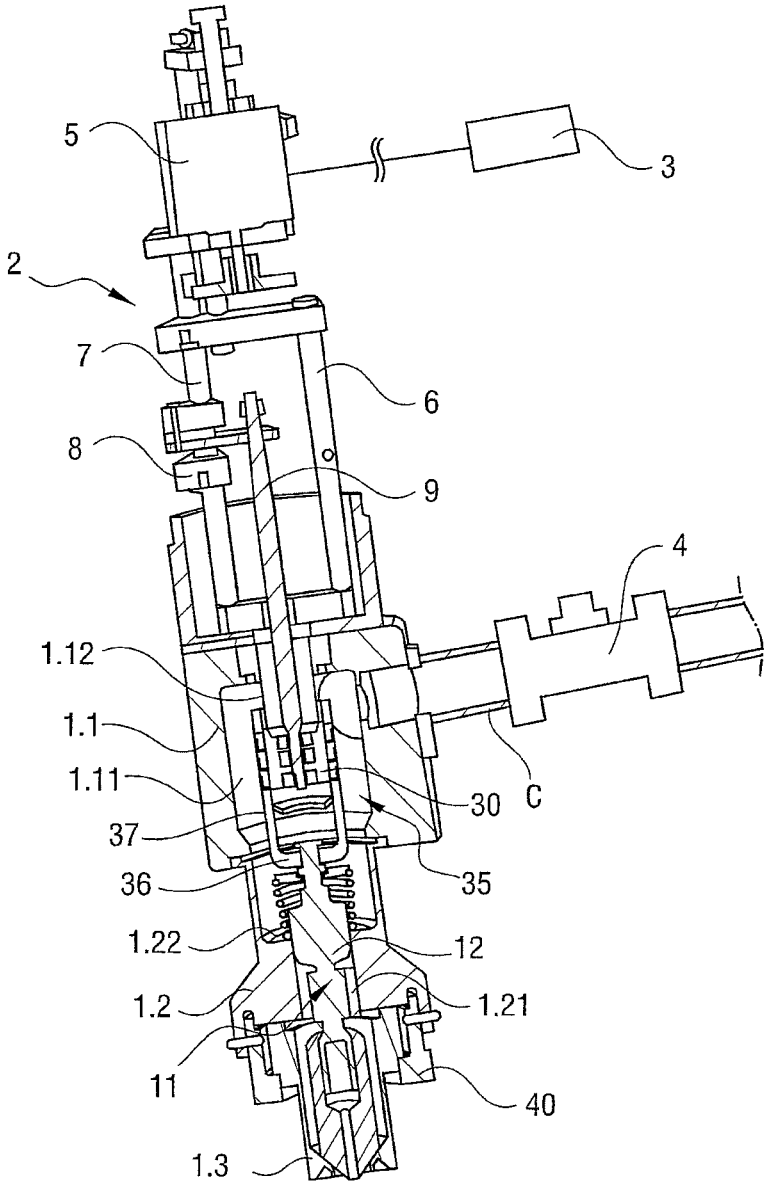
FIG. 1 is an axial section view of a filler spout of the invention.

With reference to the figures, the filler spout of the invention comprises a tubular body 1 having three body elements 1.1, 1.2, and 1.3 on a common axis and connected together by quick-disconnect fasteners.

One of the quick-disconnect fasteners can be seen in the figures and it comprises a ring 40 with an inside shoulder that receives the top end of the body element 1.3 and that is fastened by a bayonet connection to the bottom end of the body element 1.2. It should be observed that the top annular edge of the ring 40 is received in a plane groove in the bottom end of the body element 1.2 and that it compresses therein an annular sealing gasket 41.

The body element 1.2 contains a valve member, given overall reference 11, comprising a core 12 that is mounted in a bore 1.21 of the body element 1.2 and that has both an axially projecting top end from which there extends a peg 13, and also an axially projecting bottom end from which there extends a guide rod 14. Towards its top end, the core 12 has a cylindrical outside surface 12.1, and towards its bottom end, it has a frustoconical outside surface 12.2, with its small base running into the guide rod 14. Between the cylindrical outside surface 12.1 and the frustoconical outside surface 12.2 there projects an annular lip 12.3 of diameter close to the diameter of the bore 1.21.

An O-ring 15 is lightly mounted as a snug fit on the cylindrical outside surface 12.1 of the core 12 for the purpose of being pressed against a seat 1.22 in the form of a shoulder surrounding the top outlet of the cylindrical bore 1.21. The cylindrical outside surface 12.1 of the core 12 is of a length longer than the (small) diameter of the O-ring 15 so that the O-ring 15, when mounted on this surface, has axial clearance enabling the O-ring 15 to slide along the cylindrical outside surface 12.1. The O-ring 15 is pushed back towards the annular lip 12.3 by a helical spring 16 having a top end bearing against a washer 17 bearing against a shoulder of the peg 13, and a bottom end bearing against a ring 18 that is in contact with the O-ring 15 and that is mounted against the cylindrical outside surface 12.1 of the core 12 so as to slide. The ring 18 is provided with axial arms that come to bear against the washer 17. It should be observed that the ring 18 has its downward movement limited by coming to bear against the seat 1.22, and its upward movement limited by the axial arm coming to bear against the washer 17. The movement of the O-ring 15 serves in particular to clean the cylindrical outside surface 12.1 of the core 12 of the valve member 11.

The guide rod 14 has side fins 19 that serve to center the guide rod 14 in the bore 1.21 while allowing liquid to pass through.

The body element 1.3 defines a distribution chamber containing a secondary shutter 21 that is fastened to the bottom end of the guide rod 14 of the valve member 11 by means of a fin 22 so as to provide axial clearance between the valve member 11 and the secondary shutter 21. In this embodiment, the secondary shutter 21 has a conical bottom portion 23 extending facing a conical constriction 24 surrounding the outlet orifice of the body element 1.3.

The spout includes a control device given overall reference 2 for controlling the valve member 11. The control device 2 has a control unit 3 connected to an actuator and to a flow meter 4. The actuator comprises a rotary electric motor 5 mounted on a structure 6 fastened to the body element 1.1. The rotary electric motor 5 has an outlet shaft rotatably connected by a gear train to a wormscrew 7 that is mounted vertically to turn in the structure 6. A nut 8 that is prevented from rotating is mounted on the wormscrew 7 and is constrained to move in translation with a top end of a control rod 9 that has a bottom end portion slidably received in a bushing 1.12 that is mounted coaxially in the body element 1.1 so as to define a sealed enclosure that is isolated from the fluid arrival chamber 1.11 (the arrival chamber 1.11 is defined by the body element 1.1 and is connected to a feed pipe C for feeding the spout with fluid for filling). The bottom end portion of the control rod 9 is provided with ferrite rings 10 for forming electromagnetic actuator means.

A slide 30 is slidably received around the bushing 1.12 that provides accurate guidance of the actuator element 3 inside the body element 1.1. The slide 30 is provided with annular magnetic elements for creating magnetic coupling between the slide 30 and the control ring 9. The ferrite rings are preferably dimensioned so as to exert a force on the slide 30 that is nearly equal to the weight of the slide 30 plus the equipment associated therewith.

The connection between the slide 30 and the valve member 11 is provided by a coupling member given overall reference 35. In the embodiment shown, the coupling member includes a clip 36 connected to the slide 30 by connection arms 37. The clip 36 is engaged in a groove in the peg 13 with radial clearance so that accurate sliding of the slide 30 and accurate sliding of the valve member 11 in the body element 1.1 and 1.2 remain unaffected, even if the body element 1.1 and 1.2 are not mounted exactly on the same axis.

It should be observed that:

mounting the valve member and the actuator in separate body elements that are connected together by a quick-disconnect fastener and the separability of the coupling elements make it possible to set up quickly various combinations of the control member and of the shutter member; and arranging elements of the coupling member in the form of a clip and a peg having a head engaged between the branches of the clip makes it possible, after opening the quick-disconnect fastener, to dissociate the valve member and the actuator merely by shifting them laterally relative to each other.

The flow meter 4 is installed on the feed pipe C of the filler spout in order to enable the control unit 3 to control the motor 5 as a function of the flow measured in said pipe.

During a filling operation, the filler spout passes from a closed state to an open state prior to returning to the closed state.

Because of the axial clearance between the secondary shutter 21 and the valve member 11, the filler spout possesses a plurality of closed states.

Figure 2:
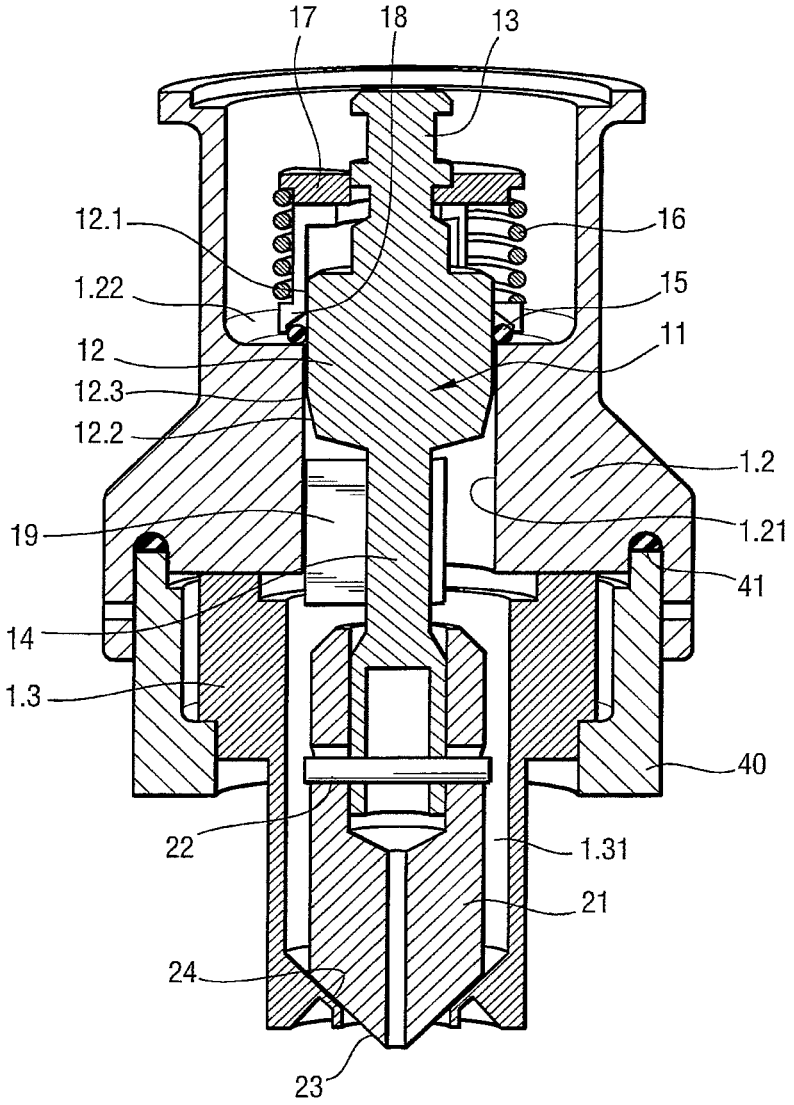
FIG. 2 is an axial section view of an end portion of the spout, the spout being in a first closed state with the valve member in its extreme closure position and the secondary shutter in its extreme closure position.

In the first closed state of the filler spout, as shown in FIG. 2, the valve member 11 is in its extreme closure position and the O-ring 15 is pressed against the seat 1.22. The secondary shutter 21 bears against the conical constriction 24 of the body element 1.3. This state corresponds to stopping filling: some fluid generally remains in the distribution chamber 1.31 defined by the body element 1.3 and there is a risk of leakage if the conical bottom portion 23 of the secondary shutter 21 does not bear accurately against the conical constriction 24. This state is only transient.

Figure 3:
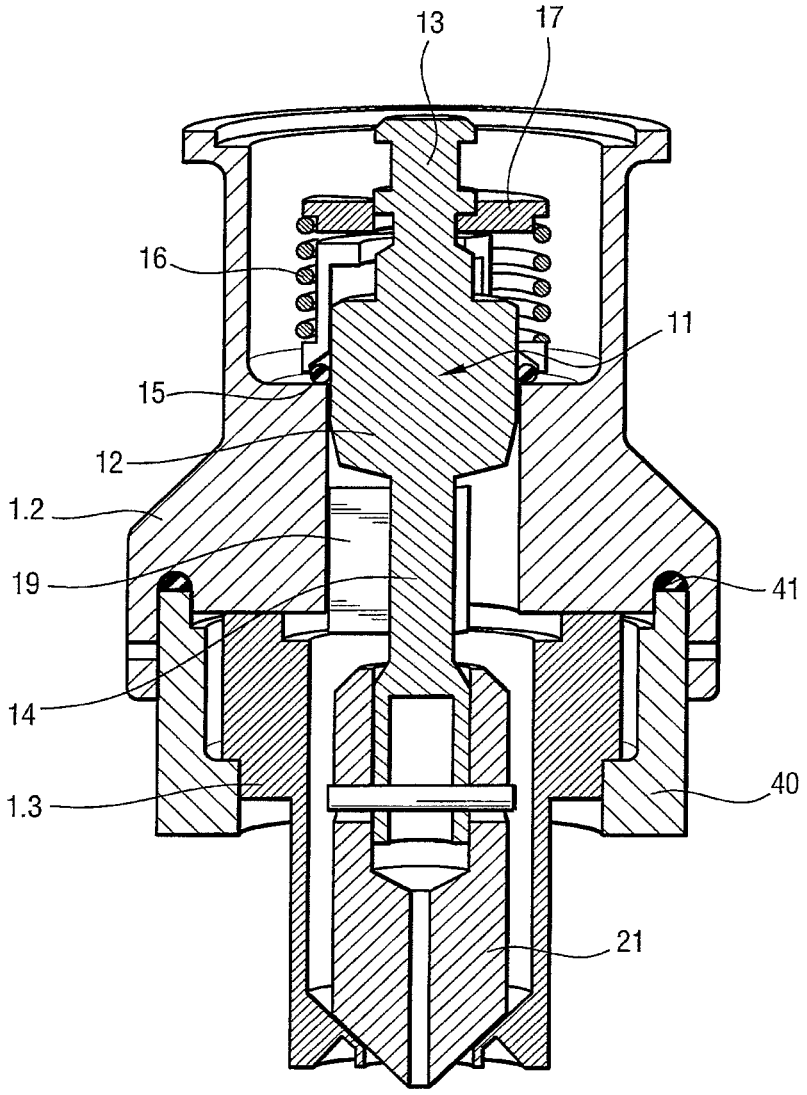
FIG. 3 is a view analogous to FIG. 2, the spout being in a second closed state with the valve member being in its intermediate closure position and the secondary shutter in its closure position.

In the second closed state of the filler spout, as shown in FIG. 3, the rotary electric motor 5 has been operated to raise the valve member 11 towards an intermediate closure position in which: the lip 12.3 remains in the bore 1.21, the O-ring 15 continues to bear against the seat 1.22, and the secondary shutter 21 bears against the constriction 24 of the body element 1.3. The movement of the valve member 11 towards its extreme opening position creates suction in the distribution chamber 1.31 and thus creates an effect of sucking up the fluid remaining in the distribution chamber 1.31. This limits any risk of leakage.

Figure 4:
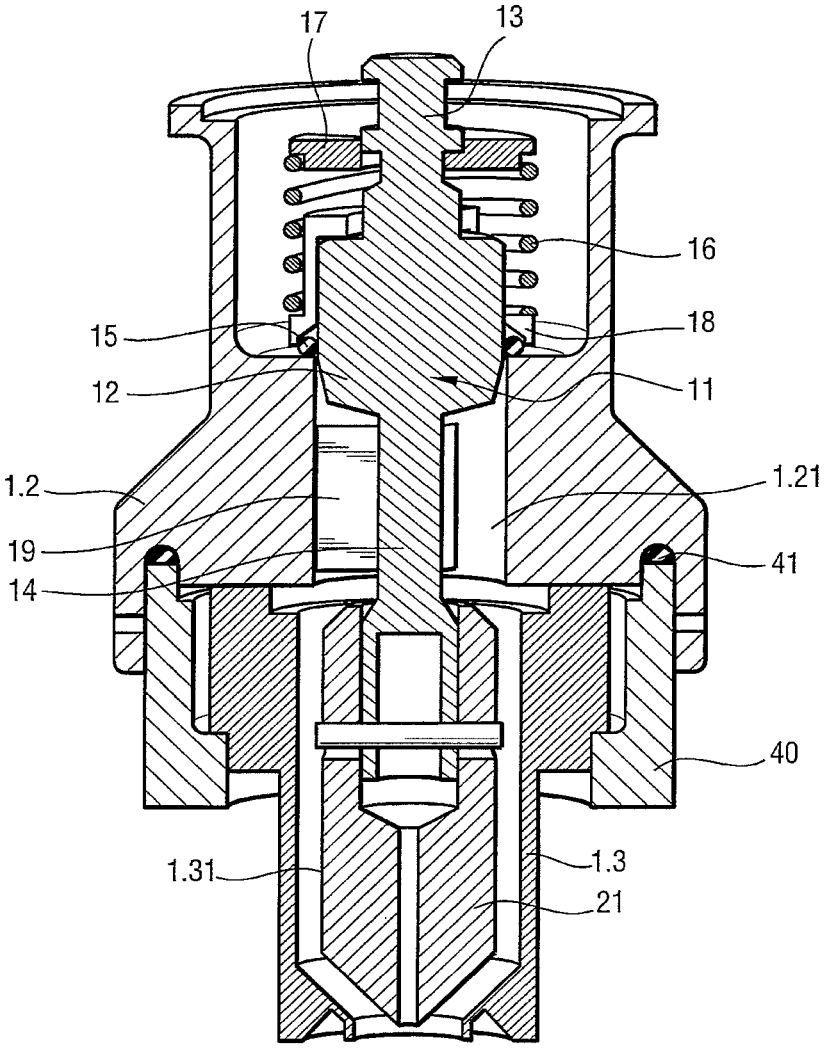
FIG. 4 is a view analogous to that of FIG. 3, the spout being in a semi-opening state with the valve member in an intermediate opening position and the secondary shutter in an intermediate position.
Figure 5:
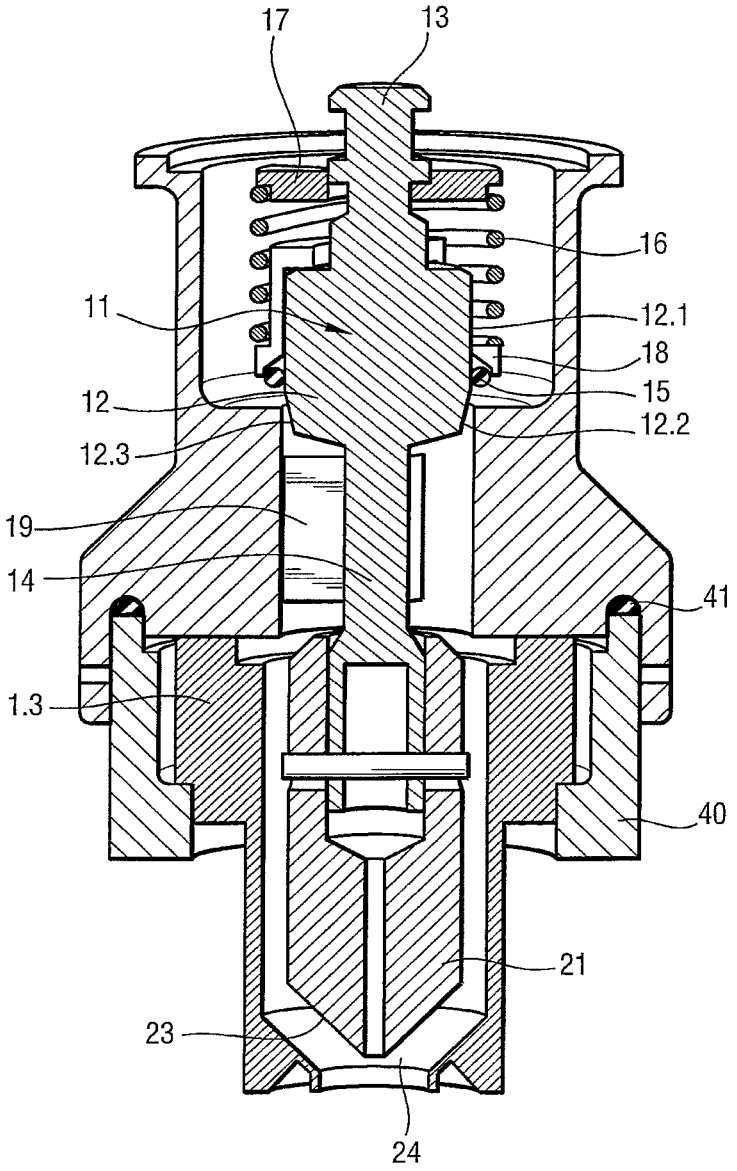
FIG. 5 is a view analogous to the view of FIG. 2, the spout being in an open state with the valve member in an extreme opening position and the secondary shutter in its extreme opening position.

In order to open the valve member 11, the rotary electric motor 5 is controlled to raise the valve member 11 towards an extreme opening position, thereby separating the secondary shutter 21 from the conical constriction 24 (FIG. 4). When the lip 12.3 reaches the O-ring 15, it separates the O-ring 15 from the seat 1.22, allowing fluid to pass towards the distribution chamber 1.31 and the outlet orifice of the spout. The frustoconical outside surface 11.2 serves to control the flow of fluid by providing relative to the edge of the bore 1.21, a through annular section that is of greater or smaller size.

The control unit 3 is arranged so that the filler spout delivers the fluid at a first rate during a stage at the beginning of filling, at a second rate during an intermediate stage, and at a third rate during a stage at the end of filling. In order to optimize the rate of filling while limiting any risk of splashing and any risk of the fluid foaming in the container, the third rate is less than the first rate which is less than the second rate. In a variant, the first and third rates may be equal to each other.

The way the valve member and the secondary shutter are arranged makes it possible, without any risk of interfering with the closure action of the valve member, to maintain a sufficient quantity of fluid in the filler spout to avoid a defect of forming the jet of fluid when opening the valve member.

Naturally, the invention is not limited to the embodiment described and embodiment variants may be applied thereto without going beyond the ambit of the invention as defined by the claims.

In particular, although the device of the invention is shown with a coupling member comprising a C-shaped clip associated with a peg, which makes it possible not only for assembly to be quick but also for cleaning to be effective since there is no need to proceed with disassembly, it is possible to use other coupling members that present radial clearance, e.g. a bayonet coupling member.

In a variant, the secondary shutter 21 may be of greater height in order to enhance laminar flow of the fluid at the outlet from the spout.

In the closed position, provision may be made for the secondary shutter 21 to extend in the proximity of the constriction 24 in the body element 1.3 rather than being in contact therewith. The dimensions and the relative positions of the conical portion and of the constriction 24 are then designed so that in the closed position, the lower conical portion 23 of the secondary shutter 21 is spaced apart from the constriction 24 with just sufficient clearance to retain the fluid contained in the body element 1.2 and 1.3 by capillarity. Such an arrangement is useful for packaging a fluid that tends to foam in the event of turbulent flow, such as milk.

The rotary electrical motor may be connected to the movable portion (the control rod) by any type of mechanism for transforming rotary motion into movement in translation.

As described above, the metering unit may comprise a flow rate sensor mounted upstream from the valve member, however, by way of alternative or in addition, it could be some other type of sensor suitable for determining the quantity of fluid that has been dispensed, e.g. a sensor for sensing the weight of a container while it is being filled.

The invention claimed is:

1. A filler spout comprising a tubular body having mounted therein a valve member extending facing a first seat and a secondary shutter arranged in a distribution chamber downstream from the valve member and rigidly connected thereto with a small amount of axial clearance between the valve member and the secondary shutter, and a movable portion of an actuator being coupled to the valve member in order to move the valve member between a transient closure position in which the valve member is in contact with the first seat and the secondary shutter is in contact with a second seat and an extreme opening position in which the valve member is lifted from the first seat and the secondary shutter is lifted from the second seat, wherein the valve member possesses a final closure position between the transient closure position and the opening position and in which the valve member is in contact with the first seat and the secondary shutter is in contact with the second seat, wherein the valve member comprises a portion that is received in a bore opening out into the distribution chamber when the valve member is in either the transient closure position or the final closure position and the valve member has an annular lip having a diameter close to a diameter of the bore in order to create a drop in pressure in said distribution chamber when the valve member is moved from the transient closure position to the final closure position, and wherein the actuator is connected to a metering unit arranged to determine a quantity of liquid delivered by the spout and to control the actuator in order to stop the liquid delivery as a function of the determined quantity by moving the valve member from the opening position to the transient position and therefrom to the final closure position.

2. The filler spout according to claim 1, wherein the actuator is a rotary electric motor connected to the movable portion by a mechanism for transforming rotary motion into translational motion, and the metering unit comprises a servo-control circuit connected to the electric motor in order to control the metering unit.

3. The filler spout according to claim 1, wherein the metering unit comprises a flow rate sensor mounted upstream from the valve member.

4. The filler spout according to claim 1, wherein the metering unit comprises a sensor for sensing the weight of a container while # the container is being filled.

5. The filler spout according to claim 2, wherein the mechanism for transforming rotary motion into translational motion is a screw-and-nut system.

6. The filler spout according to claim 1, wherein the valve member and the actuator are mounted in separate body elements that are connected together by a quick-disconnect fastener, and a coupling member has two elements coupled together via a separable connection including radial clearance.

7. The filler spout according to claim 6, wherein one of the elements of the coupling member is a C-shaped clip and the other is a peg having a head that is engaged between the branches of the clip.

8. The filler spout according to claim 1, wherein the secondary shutter is mounted in a body element that is separate from the body element including the valve member, and is connected thereto via a quick-disconnect fastener.

9. The filler spout according to claim 1, wherein the valve member includes a core having an O-ring mounted thereon, and the first seat has a chamfer at the top end of a cylindrical body element.

10. The filler spout according to claim 9, wherein the O-ring is slidably received onto the core.

* * * * *